US009757854B2

(12) United States Patent
Stoklosa et al.

(10) Patent No.: US 9,757,854 B2
(45) Date of Patent: Sep. 12, 2017

(54) MECHANISM FOR TOOL, METHOD AND MARKING SYSTEM

(71) Applicants: Anna Stoklosa, Maple (CA); Franciszek Stoklosa, Maple (CA)

(72) Inventors: Anna Stoklosa, Maple (CA); Franciszek Stoklosa, Maple (CA)

( * ) Notice: Subject to any disclaimer, the term of this patent is extended or adjusted under 35 U.S.C. 154(b) by 16 days.

(21) Appl. No.: 14/595,808

(22) Filed: Jan. 13, 2015

(65) Prior Publication Data

US 2015/0197005 A1 Jul. 16, 2015

(30) Foreign Application Priority Data

Jan. 16, 2014 (CA) ..... 2839224

(51) Int. Cl.
*B43L 13/02* (2006.01)
*B25H 7/04* (2006.01)

(52) U.S. Cl.
CPC ..... *B25H 7/04* (2013.01); *B43L 13/02* (2013.01)

(58) Field of Classification Search
CPC ..... B25H 7/04; B43L 13/02
USPC ..... 33/1 M, 23.01, 23.03, 32.1, 32.3, 45
See application file for complete search history.

(56) References Cited

U.S. PATENT DOCUMENTS 2,503,392 A * 4/1950 Kreipl ..... B25H 7/04 33/679
2,588,757 A * 3/1952 Peeples, Jr. ..... B25H 7/04 125/23.01
3,434,218 A * 3/1969 Potter ..... G01B 11/002 33/1 R
4,512,079 A * 4/1985 LeBlond ..... G01D 15/24 226/162
4,590,677 A * 5/1986 Kopp ..... B25H 7/04 33/32.1
4,665,619 A * 5/1987 Pearl ..... B25H 7/02 226/8
4,713,887 A * 12/1987 Kitamura ..... B23Q 1/621 33/1 M
5,012,584 A * 5/1991 Galan ..... G01D 15/16 33/1 M
5,148,600 A * 9/1992 Chen ..... G01B 11/002 33/1 M
5,271,305 A * 12/1993 Peters ..... B26D 1/045 33/32.1
5,309,642 A * 5/1994 McGinnis ..... B26B 29/06 33/32.2
5,383,277 A * 1/1995 Shimoda ..... B43L 13/00 33/1 M (Continued)

*Primary Examiner* — G. Bradley Bennett

(57) ABSTRACT

Particularly the present invention will allow a detail and precise contour reading and contour marking on surfaces with sharp angles, angles, curves or any difficult shapes, in particular the present invention pertains generally as a mechanism for patented tool: TOOL, METHOD AND MARKING SYSTEM, Canadian Patent No. 2,625,566, U.S. Pat. No. 8,127,457 B2. As the level of difficulty during the wood flooring/tile installation around curved and/or off angle surfaces arises, and there are limited number of workers who can perform such trade, the MECHANISM FOR TOOL, METHOD AND MARKING SYSTEM, will enable anyone who is familiar with the trade to perform the complicated assignment in a shorter period of time and without waste of material; moreover, it will allow performers to acquire the precise craftsmanship results.

3 Claims, 4 Drawing Sheets

(56) References Cited

U.S. PATENT DOCUMENTS

| | | | | | |
|---|---|---|---|---|---|
| 5,402,691 | A * | 4/1995 | Dworkowski | B23K 9/287 | 33/1 M |
| 6,138,365 | A * | 10/2000 | Wilkins | B43L 13/10 | 33/23.01 |
| 6,305,090 | B1 * | 10/2001 | Julien | B43L 13/02 | 33/41.5 |
| 7,010,861 | B2 * | 3/2006 | Nicholson | B43L 9/00 | 33/27.03 |
| 2009/0255138 | A1 * | 10/2009 | Stoklosa | B25H 7/04 | 33/32.2 |
| 2011/0162220 | A1 * | 7/2011 | Vogeler | B26B 29/06 | 33/27.03 |
| 2013/0118022 | A1 * | 5/2013 | Propp | B25H 7/04 | 33/669 |

* cited by examiner

MECHANISM FOR TOOL, METHOD AND MARKING SYSTEM

FIELD OF THE INVENTION

MECHANISM FOR TOOL, METHOD AND MARKING SYSTEM, pertains generally to marking, tracing and/or measuring surfaces adjacent to the curved and/or off angle object's surface, positioned perpendicularly to the working surface or positioned on the same surface plane as the object's surface. Particularly, the present invention should and/or will be useful for the assistance with tracing/marking/measuring: hardwood/laminate/parquet/engineering flooring, and/or tile/floor tile, and/or any kind of residential and/or commercial construction workers and/or for amateur users.

BACKGROUND OF THE INVENTION

The present invention is an accurate tracing/marking/drawing mechanism that can be used with any frame and/or in particular with application of patented invention: TOOL, METHODS AND MARKING SYSTEM of Canadian Patent No. 2,625,566, U.S. Pat. No. 8,127,457 B2. In the field where one surface should align perfectly to the other surface either perpendicularly or positioned on the same surface plane as the object's surface, where the adjoining surface to the object's surface is shaped or off/angle, the actual work (drawing exact contour on a working surface and cutting it) is very complex. Many construction workers are struggling with performing the actual work correctly without the proper marking system, and/or they are omitting projects which involve complicated cuts on different surfaces (sometimes such job involves many different surfaces and/or cuts). Only craftsmen and/or skilled and/or determined people are able to perform the challenging, curved/off angle cutting job. Therefore, the job should be done ideally that anyone who looks at the performance should admire the craftsmanship of a particular worker. Workers are dealing with difficult cuts by using carpentry tools and/or by their own ways of simplifying the process of their work. In addition, it takes a great amount of time to complete curved/off angle cuts on a long/short and/or curved/off angle surface. Currently there is patented device: TOOL, METHOD AND MARKING SYSTEM of Patent No. 2,625,566, U.S. Pat. No. 8,127,457 B2, which is helping contractors and/or amateur workers by limiting time spent on difficult cuts and ideal aligning to the assigned surface. Although the patented device is working perfectly, the improved/new mechanism is more accurate and without creating shape limits, that also could be used with said patents for the better performance. Prior to the: TOOL, METHOD AND MARKING SYSTEM, a professional worker has his/her working system, it took him/her several hours to draw and to cut the actual size of an adjacent surface to the perpendicular object's surface and/or to the object's surface positioned on the same plane level as the working surface, that aligned ideally. The time contractors invested into the performance usually extended their originally scheduled time. Naturally, there is need to simplify the project and at the same time minimize the actual time consuming the assignment but also maximize the quality of the so called professional job and/or allow other contractor workers to be assigned and equipped to perform the assignment. It is an object of the present invention to provide a new mechanism that will work perfectly with the already patented device that is TOOL, METHOD AND MARKING SYSTEM, the MECHANISM FOR TOOL, METHOD AND MARKING SYSTEM will ideally satisfy the need of craftsmanship's and/or contractor worker's and/or amateur user's needs. Matter and advantages of the present invention will be apparent from the description of the invention provided herein.

SUMMARY OF THE INVENTION

The present invention provides a mechanism/tool and system of ideally placed particles within the frame tool, that when in motion, the ideal shape can be obtained. The mechanism includes movable in four direction parts, along with the marking instrument and stopper. The components are carefully assembled to obtain the highest quality contour reader/tracer mechanism.

Operating the MECHANISM FOR TOOL, METHOD AND MARKING SYSTEM will allow:

- an accurate marking/drawing line on a required/working surface aligning ideally to the perpendicular object's surface and/or to the object's surface positioned on the same plane level as the working surface, that may be curved, off angle, or straight;
- an accurate shape that will allow after cutting, align ideally to the perpendicular object's surface and/or to the object's surface positioned on the same plane level as the working surface, that may be curved, off angle, or straight;
- an accurate shape and size of required surface that will align ideally to the perpendicular object's surface and/or to the object's surface positioned on the same plane level as the working surface, that may be curved, off angle, or straight;
- an accurate marking/drawing line, will be performed on a surface that has a variety of textures (ex. hardwood flooring, laminate flooring, parquet flooring, engineering flooring, tile, or other);
- shorten the time spent on the job site by the craftsmen and/or by the professional contractor workers along with the amateur performers. Time is an expensive factor in the present world; therefore by using the MECHANISM FOR TOOL, METHOD AND MARKING SYSTEM, the working time is automatically shortened;
- accept the contract while the job involves difficult cuts;
- allows the worker to perform the job accordingly.

The present invention will have the advantage of an easy to operate tool scheme, such as:

- easily movable, easy to handle;
- stable during performance of the actual assignment;
- allowing for an accurate reading of the sought shape and/or size of the surface that should align ideally to the adjacent surface;
- allowing any person willing to learn to operate the present invention;
- the device is working in four directions: rightward, leftward, upward, downward;
- full control over the composition, allowing the operator to move manually rightward and/or at the same time upward or downward; furthermore, the operator may move the marking instrument leftward and/or at the same time upward or downward, according to his/her assigned project.

DETAILED DESCRIPTION OF DRAWINGS

Features and advantages of the present invention can be understood in detail; a more particular description of the invention, briefly summarized beneath, may and will reference to the embodiments thereof that are illustrated in the appended drawings. It is to be noted, however, that the appended drawings illustrate the typical embodiments of this invention and are, therefore, not to be considered limiting of its scope, for the invention may admit to other equally effective embodiments.

*a*) slider,
*b*) connector,
*c*) connecting tube,
*d*) holding tube,
*e*) marking hole,
*f*) marking instrument,
*g*) marker.

Figure 3:
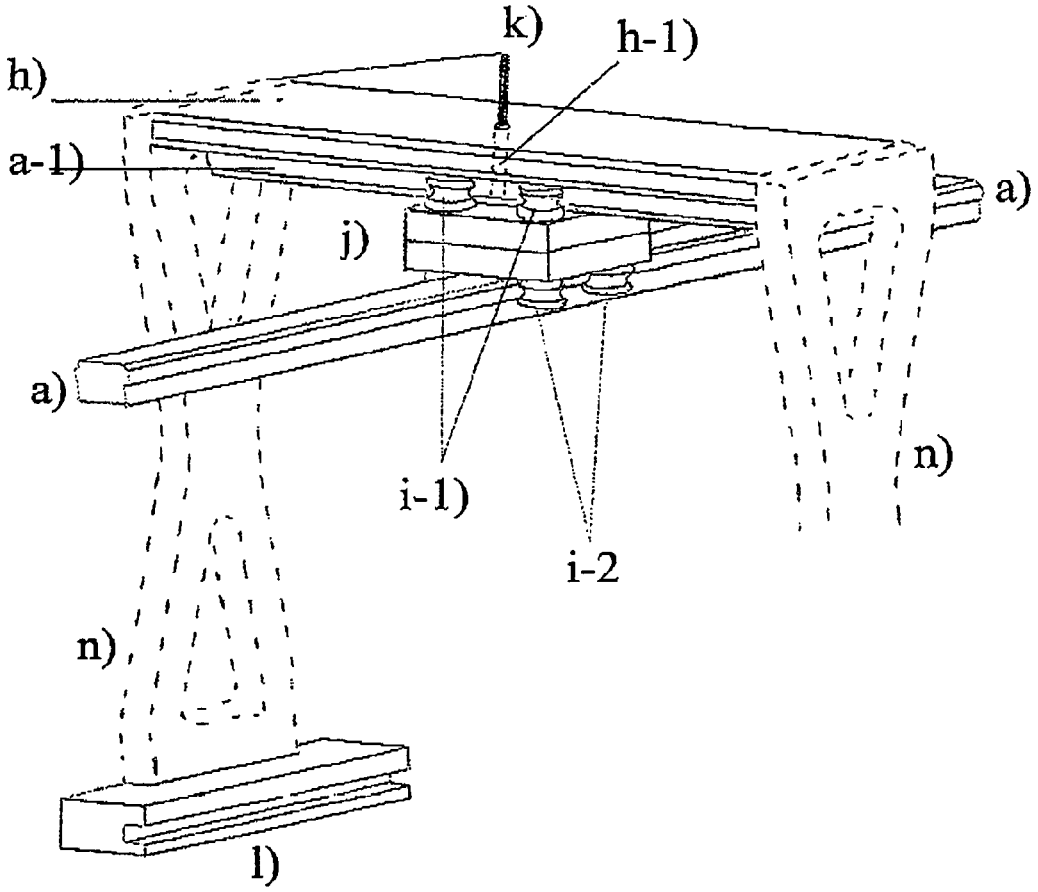

FIG. 3 Represents the movable assembly of the: MECHANISM FOR TOOL, METHOD AND MARKING SYSTEM; the following are the references to the drawing:

*a*) slider holder,
*a*-1) slider holder opening,
*b*) slider,
*b*-1) slider=FIG. 2*a*)
*c*-1) *c*-2) rolling wheels,
*d*) square blocks,
*e*) stopper (safety break),
*f*) frame system,
*g*) wood holder (holder).

Figure 4:
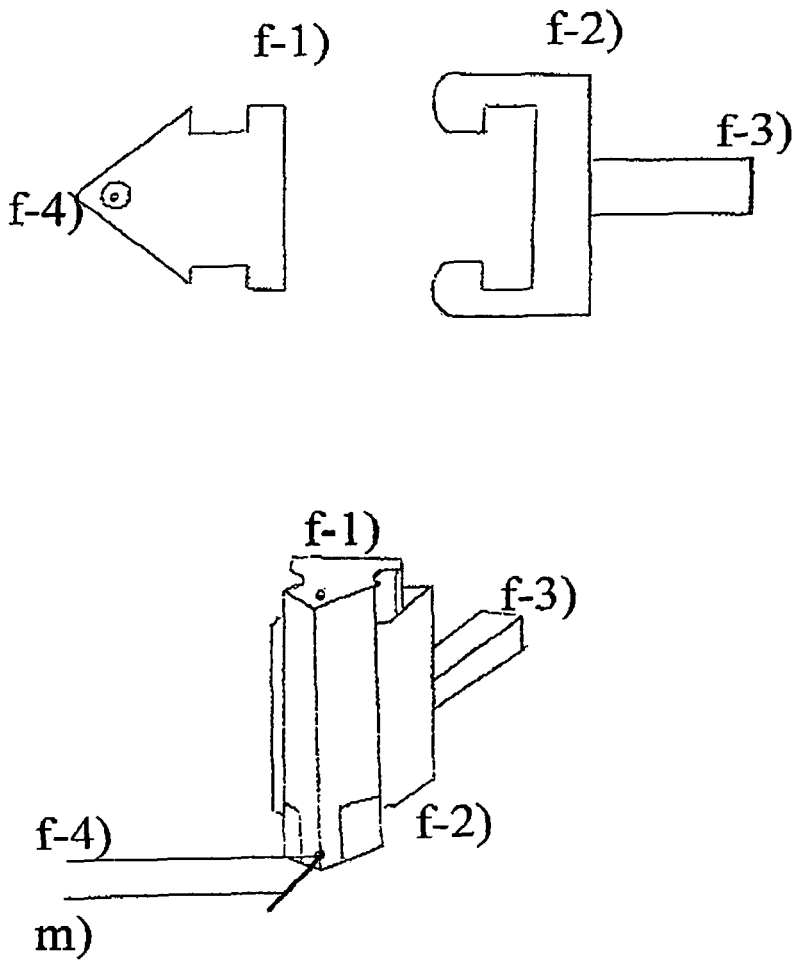

FIG. 4 Represents the movable/adjustable marking instrument of the: MECHANISM FOR TOOL, METHOD AND MARKING SYSTEM; the following are the references to the drawing:

*a*) head,
*b*) sliding neck,
*c*) neck,
*d*) pin holes,
*e*) pin.

DETAILED DESCRIPTION OF THE INVENTION

Before explaining the present invention in details, it is to be understood that the invention is not limited to its application to the details of construction and arrangement of parts illustrated in the accompanying drawings. Moreover, it is to be understood that the phraseology and terminology employed herein is for the purpose of description and not of limitation.

Figure 1:
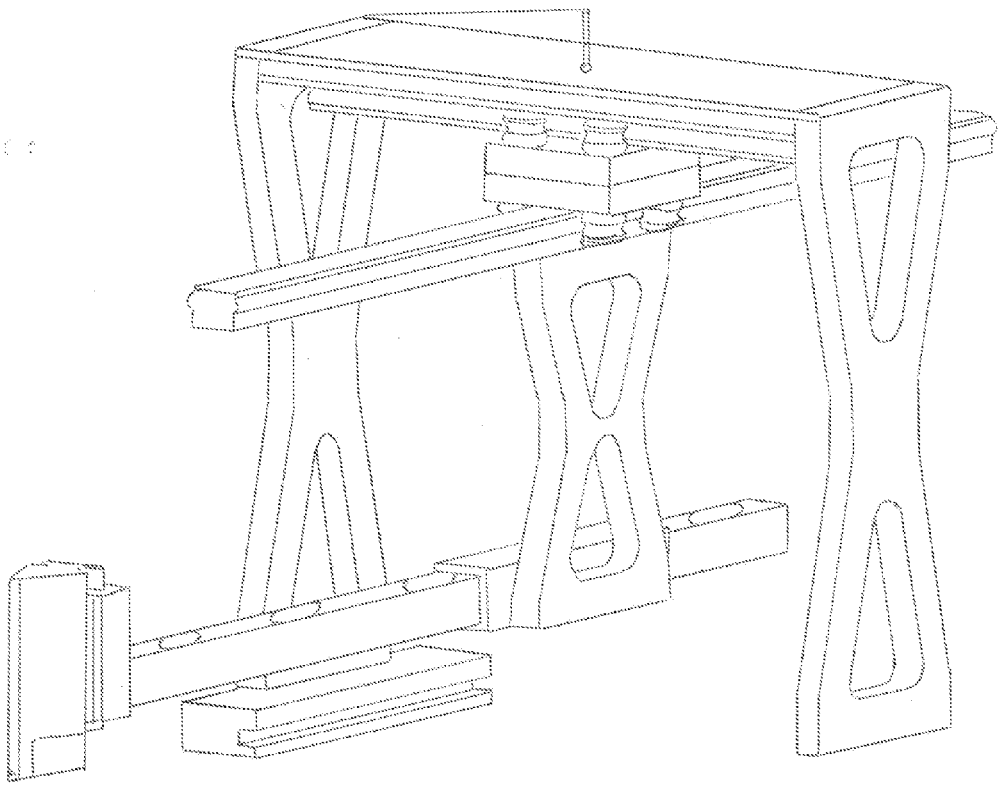
FIG. 1 Represents the MECHANISM FOR TOOL, METHOD AND MARKING SYSTEM as a complete composition ready to operate, mounted to the frame system.

In accordance with the present invention, and referring to FIG. 1, the composition comprises the complete invention, ready to be used/mounted/installed to the frame system.

Referring to FIG. 1, wherein the said mechanism system is the complete mechanism that is made with, but not limited to, metal, plastic or any durable material that will suit the needs of demands of the mechanism for a marking tool, especially the patented TOOL, METHOD AND MARKING SYSTEM of Patent No. 2,625,566, U.S. Pat. No. 8,127,457 B2.

Figure 2:
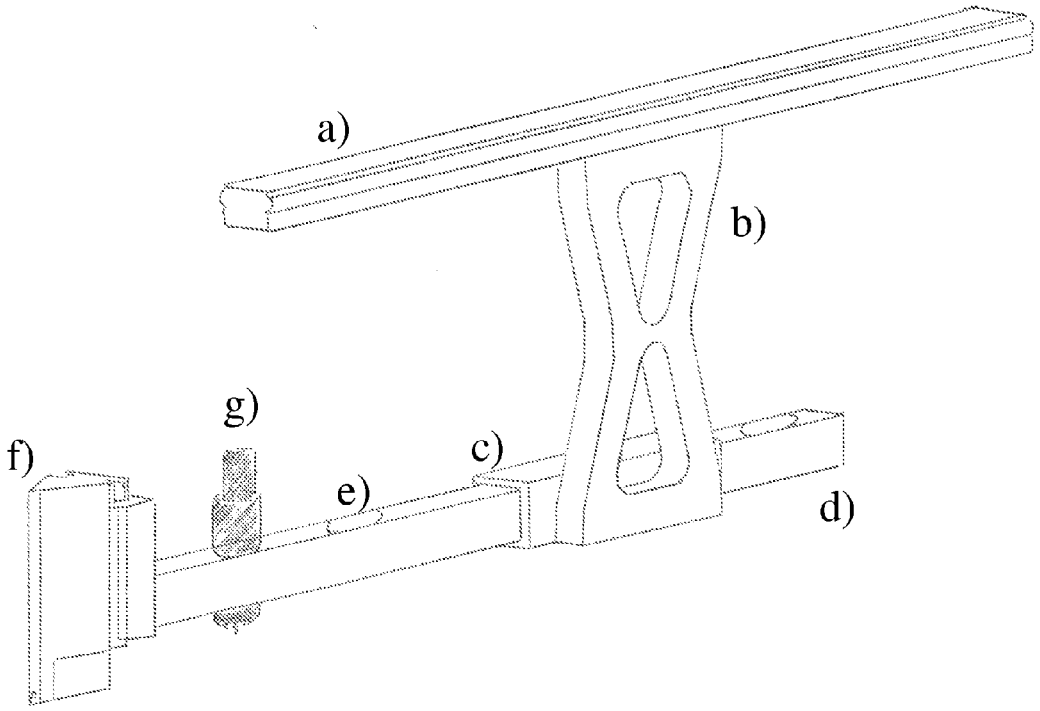
FIG. 2 Represents the convertible marking assembly of the: MECHANISM FOR TOOL, METHOD AND MARKING SYSTEM; the following are the references to the drawing.

Referring to FIG. 2, wherein the slider, FIG. 2*a*), slides into the rolling wheels, FIG. 3 *i*-2), connecting the parts for the perpendicular movement of a slider, FIG. 2*a*), to the slider, FIG. 3 *a*-1). The connector, FIG. 2*b*), is of any convenient shape and connects the slider, FIG. 2*a*), with the connecting tube, FIG. 2*c*), the connector unit is affixed into the slider from one side and into the connecting tube from the other side placing them parallel to each other. The holding tube, FIG. 2*d*), is inserted inside the connecting tube and contains marking holes, FIG. 2*e*), for the marker, FIG. 2*g*), to be inserted inside the marking hole. The marking instrument, FIG. 2*f*), is inserted into the holding tube, FIG. 2*d*).

Referring to FIG. 3, wherein the slider holder, FIG. 3*h*), and slider, FIG. 3 *a*-1), are connected together and mounted by the ends to the frame system, FIG. 3*n*), of any marking tool, or in particular to the patented TOOL, METHOD AND MARKING SYSTEM. Following, the square block, FIG. 3*i*), holds rolling wheels, FIGS. 3 *i*-1 and 3 *i*-2), in equal number/distance from both sides of the block (two sets of rolling wheels), where the upper set of the rolling wheels, FIG. 3 *i*-1), is inputted onto the slider, FIG. 3 *a*-1), and slides easily from one side to the other side. The stopper, FIG. 3*k*), stops and controls the motion of any movement of the square block and both sliders, FIG. 3 *a*-1) and FIG. 2*a*). The slider holder opening, FIG. 3 *h*-1), allows the mechanism to stop in specific position required by the operator. The wood holder (holder), FIG. 3*l*), holds the material to be traced on parallel to the slider, FIG. 2*a*), allowing the marker, FIG. 2*g*), touch the surface.

Referring to FIG. 4, wherein the marking instrument encompasses a head, FIG. 4 *f*-1), that slides into the sliding neck, FIG. 4 *f*-2), where the neck, FIG. 4 *f*-3) is mounted to the sliding neck of FIG. 4 *f*-2), to be inserted and fastened into the holding tube, FIG. 2*d*). The head includes four pin holes, FIG. 4 *f*-4), for the pin, FIG. 4*m*), to go through and touch the surface in position where needed to obtain the necessary reading.

To operate with this invention, the slider holder, FIG. 3*h*), with slider, FIG. 3 *a*-1, must be mounted into the frame system, FIG. 3*h*), of a tool/machine. The contractor worker and/or amateur performer/tool operator can easily operate the MECHANISM FOR TOOL, METHOD AND MARKING SYSTEM by placing the tool (said mounted composition) on the tracing surface with direction of the invention facing the surface from which the contour will be transferred; furthermore, the tracing surface can be located on the same surface plane as the contoured/irregular shaped/off angle/curved surface, or the tracing surface can be located perpendicular to the contoured/irregular shaped/off angle/curved surface that is difficult to mark/trace the contour without the tool. To place the composition on a designated surface, position the slider along the surface plane with the stopper on/fastened, FIG. 3*k*), not allowing to move the slides. FIG. 2*a*) and FIG. 3 *a*-1), locate marking instrument, FIG. 2*f*), by the contoured/irregular shaped/off angle/curved surface, allowing the pin, FIG. 4*m*), to touch the necessary contour, at the same time have ready marker, FIG. 2*g*), in the necessary marking hole, FIG. 2*e*); furthermore, loosen the stopper, FIG. 3*k*), and using hands allow the pin touch the contoured surface and the marker the tracing surface, marking the surface accordingly to the contour. The motions of the sliders are in four directions: rightward-leftward, downward-upward, the rolling wheels help to slide the slider in an ideal motion leaving the perfect contour traced/marked to be cut and inputted/installed in the place. The marker is placed in the marking hole and in tube with gravity system (patent pending application), to obtain the best results of the contour/marker. Once the tracing/marking is performed, the stopper must be fastened and the procedure repeated until the work is completed.

What is claimed is:

1. An apparatus for marking and measuring flooring/surfaces according to a required shape, such as a contour, comprising:

a) a movable assembly comprising: a pair of two rail members connected perpendicularly by engaging piece; wherein said piece comprises bearings/bearing slots allowing said rails for easy movement in any given directions; wherein horizontal rail is mounted by its sides to the frame system; wherein the vertical rail is mounted to the connecting member respectively to the tube; wherein said tube acts as convertible member; whereas said vertical rail is respectively inserted into said bearing slots;

b) a convertible marking assembly comprising: a tube parallel mounted by connecting member to the vertical rail; wherein said tube is hollow inside corresponding with respect to long member of movable marking assembly; wherein namely convertible means said movable marking assembly member can be inserted from both sides of said tube;

c) a movable marking assembly comprising: two ideally fitted/adjusting neck-head pieces; wherein head assembly is portable and adjustable comprising openings for contour marking pins; wherein neck assembly is mounted to the long member; wherein said long member comprises openings for marking instruments and fits respectively inside the convertible tube;

d) a frame assembly comprising: a pair of spaced apart side members, connected at a top end by horizontal member parallel to horizontal rail; whereas said horizontal member comprises opening and corresponding stopper, each side members further comprises base member at a bottom end thereof; wherein one base member comprising a downwardly extending holding piece member for engaging and adjacent piece of flooring so as to provide a secure and parallel placement of the frame assembly with respect to the adjacent piece of flooring; whereas a second base member is portable and if needed acts respectively as level stabilizer.

2. The marking apparatus of claim 1, wherein said marking assembly comprises any object capable of marking or scribing said contour on said flooring surface.

3. A method of using marking apparatus of claim 1, wherein the extending holding piece member is engaged with adjacent piece of the flooring to ensure parallel alignment of the frame assembly, long member of marking assembly is adjusted to an appropriate size; said contour marking pin is extended and/or bent to suit the particular application; the movable assembly and the movable marking assembly are displaced so as to follow the shape of the contour while marking object is in contact with a piece of flooring/surface to be marked so as to transpose shape of the contour onto the piece of flooring/surface to be marked; wherein not in use, said stopper is inserted into the opening to prevent movable assembly from movement.

* * * * *